United States Patent [19]

Hallez

[11] Patent Number: 4,832,138

[45] Date of Patent: May 23, 1989

[54] DEVICE TO CONTROL THE LOCKING OF A BORING CORER

[75] Inventor: Charles Pierre Hallez, Tellin, Belgium

[73] Assignee: Diamant Boart S.A., Brussels, Belgium

[21] Appl. No.: 174,556

[22] Filed: Mar. 29, 1988

[30] Foreign Application Priority Data

May 13, 1987 [BE] Belgium ..... 8700526

[51] Int. Cl.[4] ..... E21B 25/02; E21B 34/10

[52] U.S. Cl. ..... 175/247; 175/243; 175/317

[58] Field of Search ..... 175/236, 243, 244, 246, 175/247, 317

[56] References Cited

U.S. PATENT DOCUMENTS

| | | | |
|---|---|---|---|
| 2,491,682 | 12/1949 | Muhlbach | 166/243 |
| 3,266,835 | 8/1966 | Hall et al. | 175/246 X |
| 3,340,939 | 9/1967 | Lindelof | 175/246 |
| 4,187,919 | 2/1980 | Lambot | 175/246 |
| 4,418,770 | 12/1983 | Lambot | 175/246 X |
| 4,452,321 | 6/1984 | Eriksson | 175/243 X |

FOREIGN PATENT DOCUMENTS

| | | |
|---|---|---|
| 900733 | 3/1987 | Belgium . |
| 2359273 | 2/1978 | France . |

*Primary Examiner*—Stephen J. Novosad

*Attorney, Agent, or Firm*—Sughrue, Mion, Zinn, Macpeak, and Seas

[57] ABSTRACT

To control the locking of a cable boring corer (1), a control device (30) is used, comprising a deflecting casing (33), a sleeve (31) and a piston (32), which are movable in relation to the deflecting casing (33). The piston (32) is able to be rendered integral in a lower position, under hydraulic pressure, with the sleeve (31) by a finger (43). When the hydraulic pressure is released, the sleeve (31), which is integral with the piston (32), is brought into an upper position which allows the circulation of a boring liquid through the deflecting casing (33) towards a boring crown (4).

12 Claims, 5 Drawing Sheets

DEVICE TO CONTROL THE LOCKING OF A BORING CORER

BACKGROUND OF THE INVENTION

The present invention relates to a device to control the locking of a cable boring corer for a damp shaft, this corer comprising an exterior tube in which an interior tube slides, constituted by an attachment head and a cylindrical body possibly provided with a hydraulic tightness joint with the exterior tube and by means for the locking of the interior tube in relation to the exterior tube.

PRIOR ART

Through the Belgian Pat. No. 900 733, a device is known of the type described in the first paragraph of the present specification.

In this known device, a bistable eclipsable lock ensures the hydraulic tightness of the interior tube with the exterior tube, when this lock is pushed back towards a lower position by a hydraulic pressure by means of an injection pump for the boring liquid, i.e., when the said pressure of the boring liquid exceeds a predetermined value. On the other hand, the lock permits the circulation of the boring liquid when the pressure is lower than the said value, but greater than the returning force necessary for the opening of a valve to regulate the flow of the boring liquid.

This device, although perfected, has the disadvantage of being technically complex and of easily jamming in the presence of boring sludge which prevents the bistable lock from carrying out a movement of rotation about a vertical axis to occupy the prescribed lower and upper positions. Nor does this device permit the device to control the locking of a boring corer to be returned, by a simple operation, into its initial state.

BRIEF DESCRIPTION OF THE INVENTION

The device according to the invention aims to remedy these disadvantages, whilst retaining the advantages of the known device to control locking, i.e. a device which does not require checking from the development of the water pressure to the injection pump, if the locking has in fact taken place.

The device according to the present invention of the type described in the first paragraph of the present specification, is characterized in that it comprises a deflecting casing, a sleeve and piston which are movable one in relation to the other and in relation to the corer, and also a means associated with the sleeve or with the piston to render them integral with each other when a hydraulic pressure greater than a predetermined value has brought the piston into a lower position, which ensures the hydraulic tightness of the interior tube with the exterior tube, such that, when the hydraulic pressure is reduced to a value lower than the predetermined value, the sleeve which is integral with the piston is brought into an upper position, such that it permits the circulation of the boring liquid between the exterior tube and the interior tube through the deflecting casing.

According to a characteristic of the device according to the invention, the piston is subjected, in the course of boring, to a hydraulic pressure on the one hand and to a counter force on the other hand, of a predetermined value which opposes the displacement of the piston under the action of the hydraulic pressure, such that the piston can only be rendered integral with the sleeve when the hydraulic pressure applied on the piston is greater than this predetermined value and the means to render the piston integral to the sleeve is constituted by at least one finger, which is able to project again at one and the same time in the sleeve and in the piston.

In one form of embodiment, the piston has a head which has a cavity in which the finger, which is intended to render the piston integral to the sleeve, is introduced at least partially and is, preferably, subjected to the action of a force so as to ensure a permanent contact of this piece with a surface of the sleeve when the piston, not yet integral to the sleeve, is brought into the above-mentioned lower position by hydraulic pressure.

Other characteristics and details of the invention will become apparent in the course of the following detailed description, referring to the attached drawings, which illustrate, by way of example, one form of embodiment of the invention.

DETAILED DESCRIPTION OF THE PREFERRED EMBODIMENTS

In these figures, the same reference numbers designate identical elements.

Figure 1:
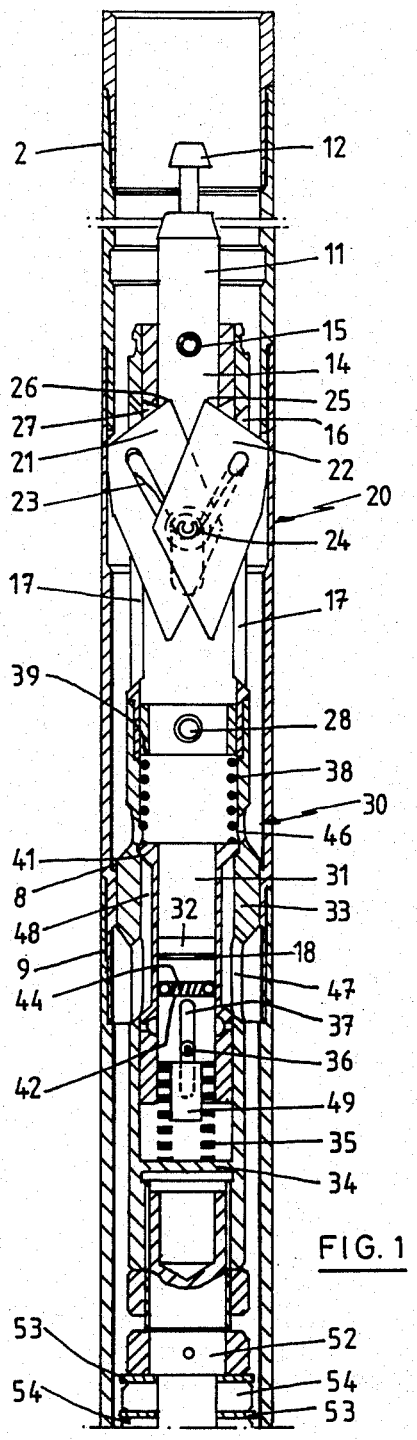
FIGS. 1 to 6 are transverse section views of a corer provided with a device to control the locking in which the piston occupies successively an upper free position, a lower integration position and an upper position of free passage through the deflector.

FIG. 1 shows a cable corer designated as a whole by reference number 1. This corer 1 comprises a tube 2, provided at one end 3 with a boring crown 4 and at the other end with an assembly thread. This corer 1 also comprises an interior tube 5 which is coaxial to the tube 2 and is equipped at its end 6 adjacent to the crown 4, with a core extractor sleeve 7.

The interior tube 5 is brought into the coring position by allowing it to slide along the tube 2 in a free fall if the hole is damp or by means of an inshot in a dry hole. In this latter case, the inshot itself serves to control the locking.

In its lower position, the interior tube 5 is suspended in the exterior tube 1 by an annular rim 8, resting on a ring, or a suspension stop 9 integral with the exterior tube 2.

The corer is provided at its upper part with a lock holder 10 and with an attachment head 11 which has a hook 12 in the shape of a truncated cone. The attachment head 11 is introduced into a slide 14 of the lock holder 10 and is connected to the latter by a pin 15. The slide 14 has a diametrical slit 16, and also two diametrically opposed elongated openings 17. The unlocking pin 15 can slide in relation to the lock holder 10.

The unlocking slide 14 has an unlocking pin 19.

The lock holder 10 protects a lock 20 constituted by two flat locking sheets 21, 22, housed in the slit 16, these sheets being acted upon by a spring 23 so as to allow them to pivot about a pivot 24 and to part their upper ends 25, 26 one from the other. The lock holder 10 also has two unlocking spaces 27.

A pin 28 connects the lock holder 10 to the remaining part of the interior tube 5.

An annular interstice 29 is provided between the exterior tube 2 and the interior tube 5 to supply the lower region of the corer with water in order to cool the tool on coring and to evacuate the boring debris.

Below the pin 28 there is situated a device to control locking, designated as a whole by reference number 30.

This device 30 comprises a sleeve 31 and a piston 32 which are movable in relation to a cylindrical casing 33. This casing, resting along the rim 8, on a suspension ring 9, plays the part of a deflector. An o-ring 18 ensures the tightness of the piston 32 in relation to the sleeve 31.

The casing 33 has a base 34, when the piston 32 is pushed back towards a lower position, for example when the hydraulic pressure due to the height of the column of boring liquid, to which is added the pressure of the pumps of the boring liquid on the surface, is greater than the force exerted by a powerful spring 35 on this piston 32, all circulation of the fluid between the exterior tube 2 and the interior tube 5 is impossible.

The spring 35 must be dimensioned such that it is able to bear the column of liquid which hangs over it. The power required to overcome the pressure exerted by the column of water on the sleeve 31 and the piston 32 is in fact enormous.

The locking device according to the invention has the not inconsiderable advantage of allowing the spring 35 to exert the maximum pressure required, at the moment at which it is totally compressd.

The movements of the piston 32 and of the sleeve 31 are guided by means of a pin 36 which is integral with the deflecting casing 33, which slides in elongated holes 37 arranged in the piston 32 and the sleeve 31.

The sleeve 31 is subjected to the action of a spring 38, resting on a disc 39, which is integral with the cylindrical casing 33. This spring 38 allows an annular rim 40 of the sleeve 31 to be applied on a seat 41 of the casing 33, when the sleeve 31 is not rendered integral with the piston 32, so as to prevent the circulation of the boring liquid between the exterior tube 2 and the interior tube 5.

When the hydraulic pressure applied on the piston 32 is sufficient to bring a cavity 42 of the piston in which there is housed a ball 43 pushed back by a spring 44, opposite a hemispherical hollow 45 of the sleeve 31, the ball 43 projects into this hollow 45 so as to render the sleeve 31 integral with the piston 32. When the hydraulic pressure is then released, the piston 32 is pushed back at the same time as the sleeve 31, under the effect of the spring 35, towards an upper position, so as to allow the circulation of the boring liquid through the deflecting casing 33, between the exterior tube 2 and the interior tube 5. To this end, the casing 33 comprises holes or ports 46 and 47 at its ends, allowing the passage of the boring liquid. The boring liquid may in fact pass through the holes 46 at the head of the casing 33 in the annular space 48 situated between the sleeve 31 and the casing 33 and then through the holes 47 at the tail of the deflecting casing 33 in the interstice 29 situated between the exterior tube 2 and the interior tube 5.

When the hydraulic pressure applied on the piston 32 is not sufficient to bring the ball 43 opposite the hollow 45, the sleeve 31 is not rendered integral with the piston 32. Thus, when the hydraulic pressure is reduced, only the piston 32 is pushed back towards an upper position, thus preventing any circulation of the boring liquid in the annular interstice 29 situated between the exterior tube 2 and the interior tube 5.

The piston 32 is advantageously provided with a coaxial stem 49 serving to guide and centre the spring 35, and also to limit the displacement of the piston 32 when the latter is subjected to a pressure greater than that which is necessary to bring the cavity 42 opposite the hollow 45.

Figure 2:
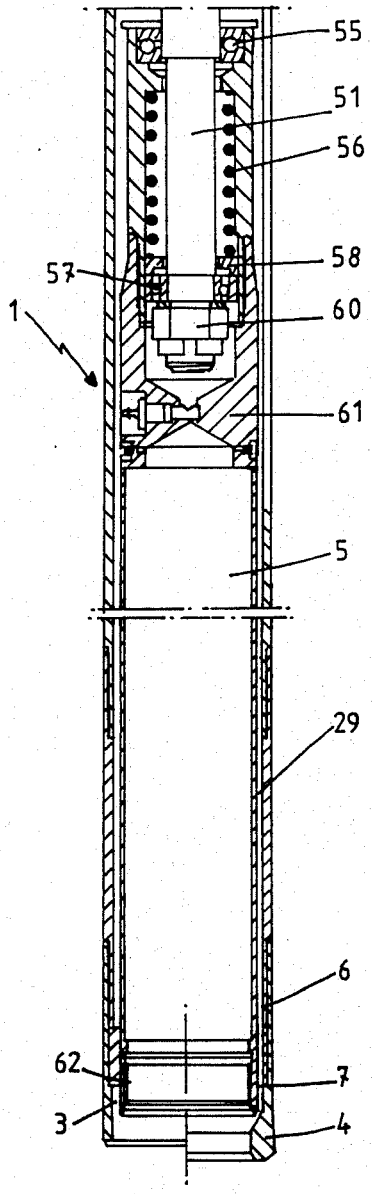
Figure 4:
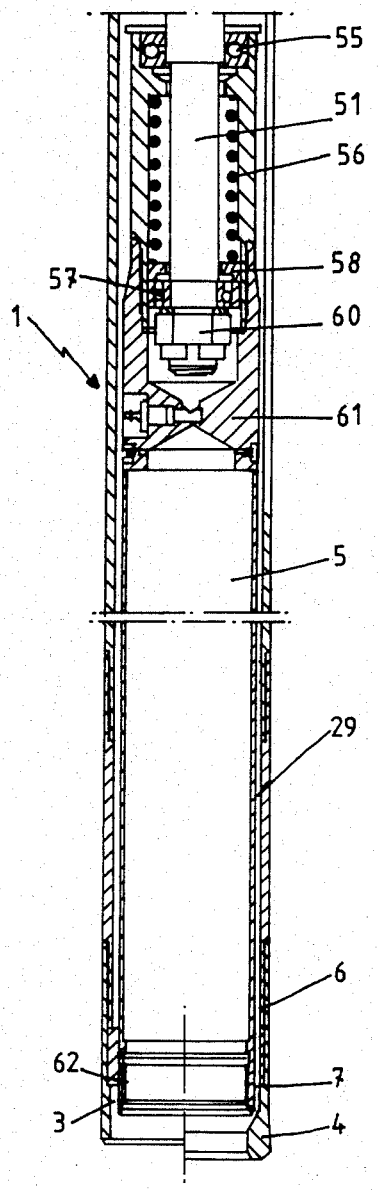
Figure 5:
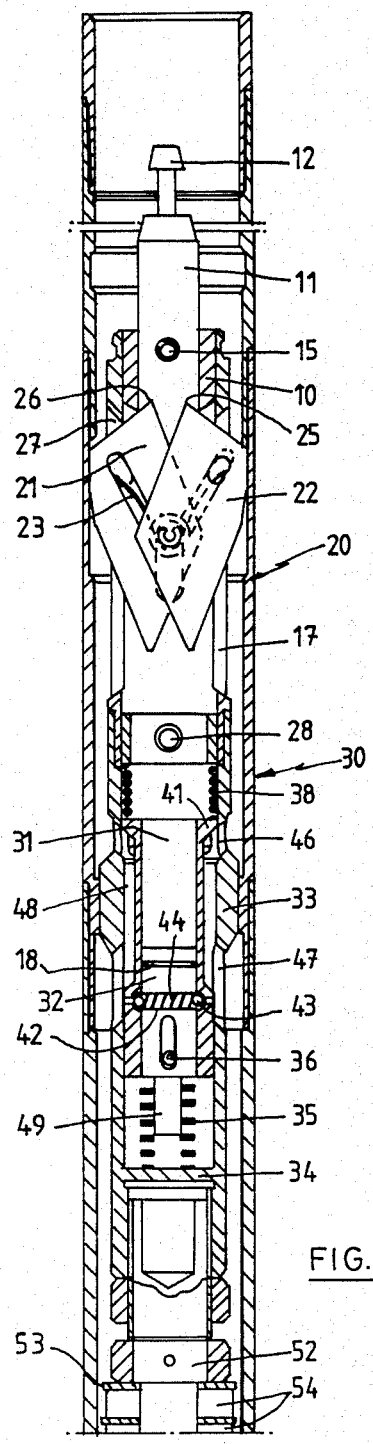
Figure 6:
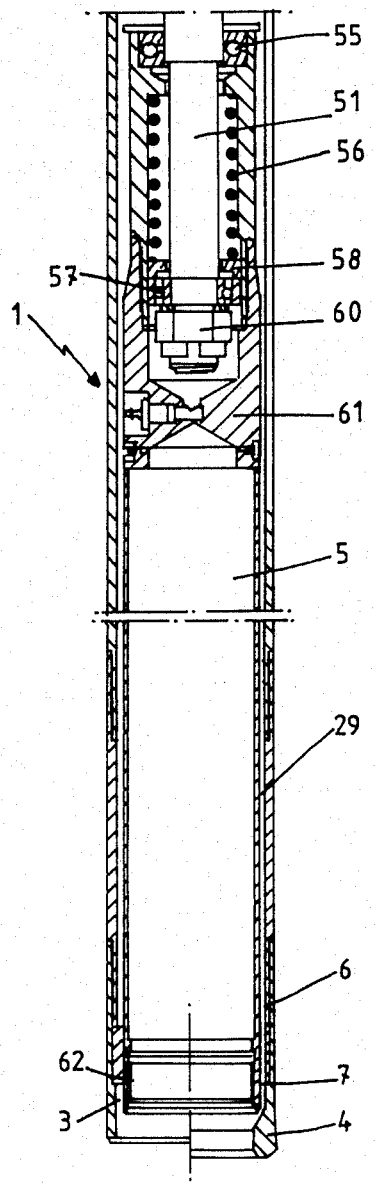

As illustrated in FIGS. 2, 4 and 6, and as described in the French Certificate of Utility No. 7.720.085, published under No. 2.359.273, a solid shaft 51 is screwed on the deflecting casing 33 at the lower part of the corer. The shaft 51 carries around it and from top to bottom, a first retention ring 52, support washers 53, expansion rings 54 between the latter, a first ball stop 61, a bracing sleeve 56, a ball bearing 57, a spring 58 and a second retention ring 59. The mechanical elements 53 to 58 surrounding the shaft 51 are held closely between the two retention stops 52 and 59 by a self-locking nut 60, screwed on the lower threaded end of the shaft 51. In addition, the bracing sleeve 56 has a threaded part on which there is screwed a support 61 for the interior tube 5. The lower tapped part of the support 55 carries a tube 5 serving to receive a core. In the lower part of the receptacle tube the extractor sleeve 7 is screwed, which is provided with an extractor spring 62.

The ball 43 may be replaced by any other piece of any form, and is advantageously subjected to a light pressure, due for example to the force of a spring 63 resting on the base of the cavity 42, so as to ensure a permanent contact between the ball 43 and the lateral surface of the sleeve 31 when the latter is not yet rendered integral with the piston 32.

The hollow 45 of the sleeve 31 communicates through a duct 64 with the outer surface of the sleeve 31. Thus, when the sleeve 31 and the piston 32 are integral one with the other and are no longer subjected to the action of a hydraulic pressure, the application of a force, through the duct 64, by means of a stem on the ball 43 to dislodge it from the hollow 45 allows the piston 32 and the sleeve 31, owing to the action of springs, to separate one from the other and, being rendered non-integral one with another, to occupy their initial upper position.

The device to control locking according to the invention functions as follows:

An interior tube of a cable boring corer 1 is introduced into a string of boring rods constituting the exterior tube 2. The descent of the interior tube of the corer 1 may be accelerted by the injection of boring liquid in the said string of rods.

When the interior tube of the corer is suspended in the exterior tube 2, i.e. the annular rim 8 of the deflecting casing rests on the suspension ring 9 of the exterior tube 2, the piston 32 is brought towards a lower position due to the hydraulic pressure of the boring liquid acting in opposition to the action of the powerful spring 35. (FIGS. 1 and 4).

When the piston 32 is in the lower position, the deflecting casing 33 is totally shut off and the flow of boring liquid becomes zero. The sleeve is tightly applied on its seat arranged in the deflecting casing and the boring liquid can not pass either on the exterior side of the casing nor on the interior side of the deflecting casing. The pressure of boring liquid increases up to the moment at which the safety valves, mounted at the surface on the pumps for the boring liquid, come into action and begin to release the boring liquid.

The piston is repelled downwards as long as the pressure of the boring liquid exceeds a predetermined value. In the extreme lower position of the piston, the longitudinal groove is resting against the pin 36. In this lower extreme position of the piston, the cavity 42 is situated opposite the hollow 45 and the sleeve 31 becomes integral with the piston, due to the ball 42 which, by the action of the spring 63, projects in the hollow 45. This operation allows it to be ensured that the locking of the corer has indeed been carried out.

Figure 3:
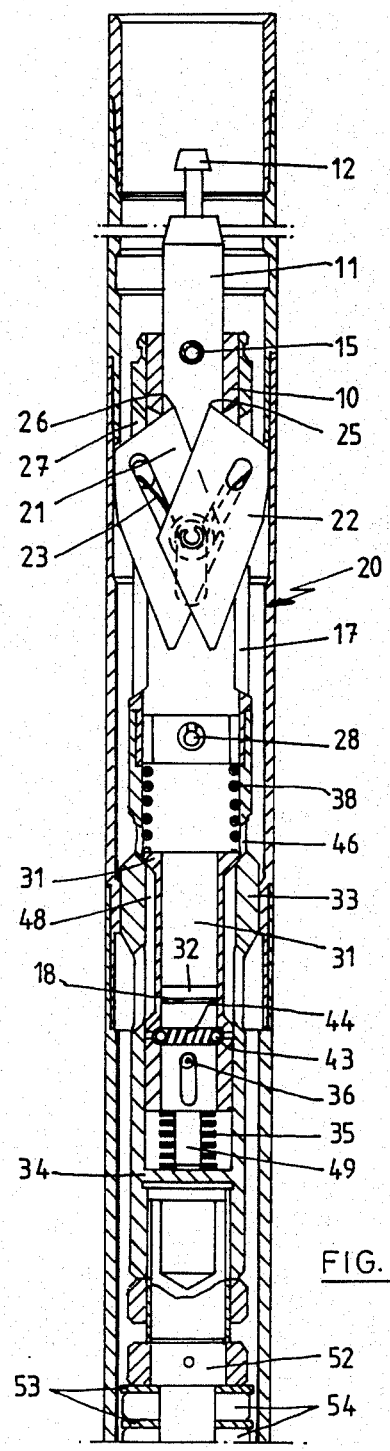

Then, when the hydraulic pressure is released, the piston 32 leaves the lower position shown in FIG. 2 and raises the sleeve 31 (see FIG. 3), this allows the circulation of the boring liquid through the upper holes of the deflecting casing 33 in the space 44 situated between the sleeve 31 and the casing 33 and through the lower holes 45 of the casing 33 in the space 29 situated between the exterior tube 2 and the interior tube 5. The coring operation may then take place.

Once the sleeve 31 has occupied the upper position, the locking device 30 is insensitive to any new increase in pressure. If the pressure of the boring liquid were to start to increase again, this pressure would act on the two opposed faces of the sleeve 31 and also on the two opposed faces of the piston 32. The piston 32 and the sleeve 31 remain insensitive to any new increase in pressure.

When the coring is finished, the interior tube of the corer is brought up again to the surface of the shaft and the core is withdrawn from the receptacle tube 5. The spring 35 is slackened whilst the spring 38 is compressed. To return the sleeve 31 and the piston 32 into their initial position, so as to be able to re-use the corer, it is sufficient to apply a force on the finger or the ball 43, by means of a stem which is not shown, through the duct 64, so as to push it back and dislodge it from the hollow 45 of the sleeve 31. In fact, when the ball 43 is dislodged from the hollow 45, the action of the spring 38 on the sleeve 31 allows the latter to slide downward in relation to the piston 32 and to resume its upper, non-integral starting position and the action of the spring 37 on the sleeve 31 allows the latter to be applied on the seat 41 of the deflecting casing 33, so as to prevent the circulation of any boring liquid between the exterior tube 2 and the interior tube 5 when the latter is suspended in the exterior tube 2.

Figure 7:
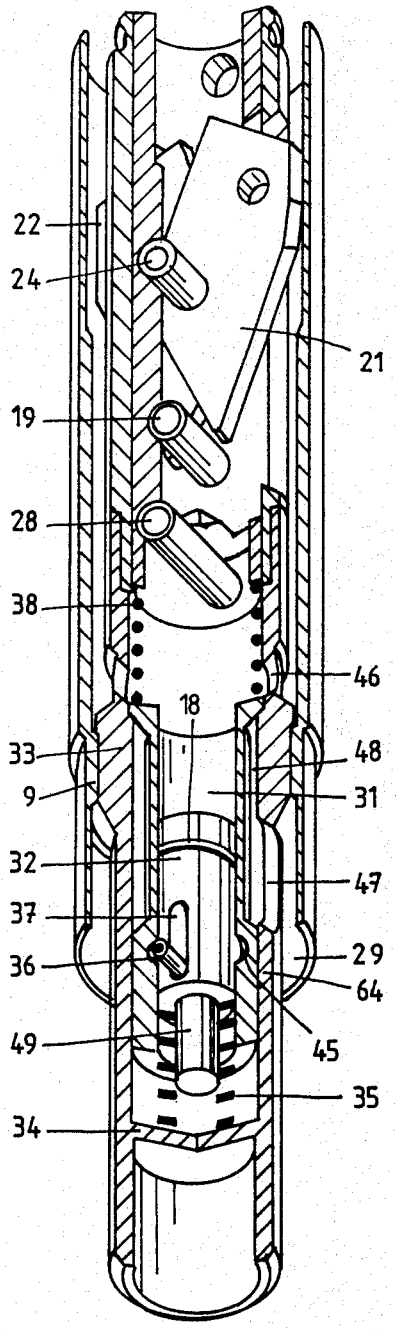
FIGS. 7 to 9 represent in section and in perspective the device to control locking of FIGS. 1, 3 and 5.
Figure 8:
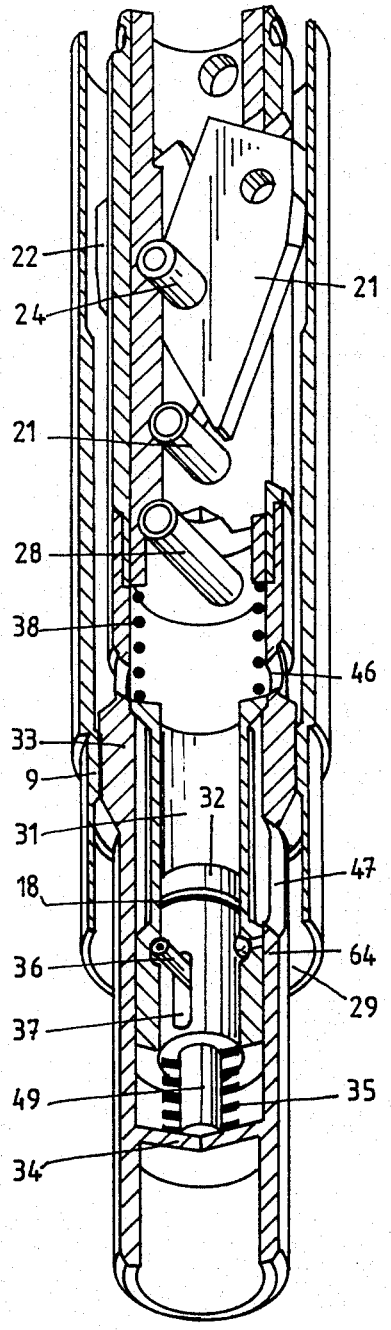
Figure 9:
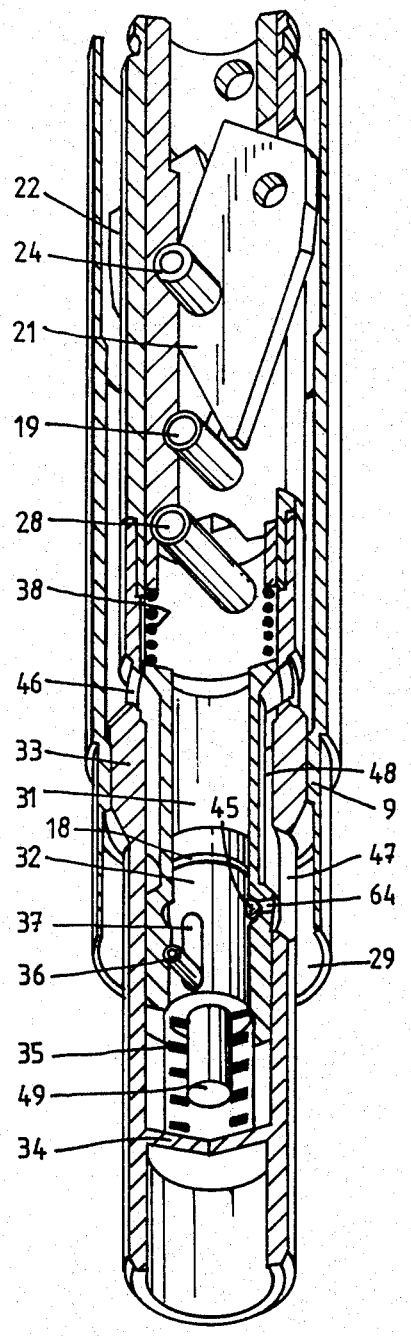
Figure 10:
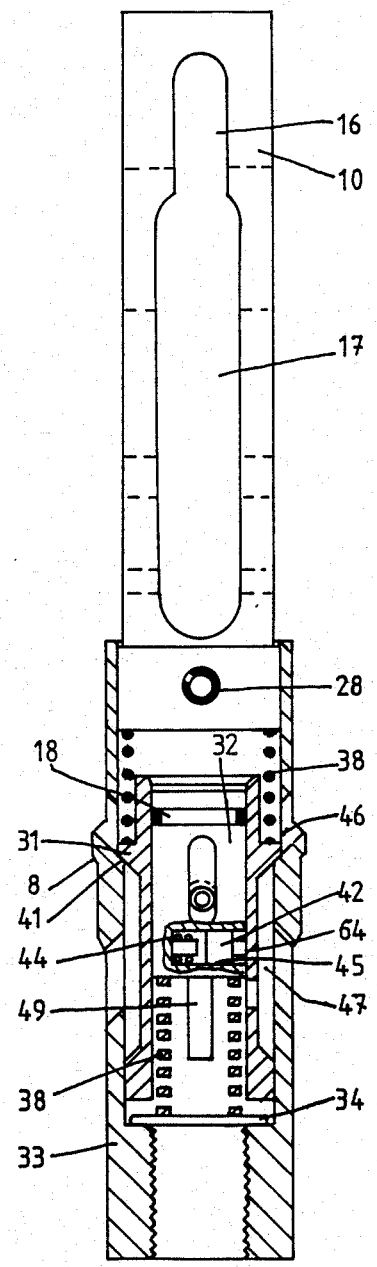
FIG. 10 shows in section a second form of embodiment of a device to control locking according to the invention, equipping a corer of a different type from that shown in FIGS. 1 to 3.

In a second form of embodiment, illustrated in FIG. 7, the finger 43 is arranged beneath the pin 36, so as to allow a more compact construction.

It is evident that many modifications are possible without departing from the framework of the present invention. Thus, the shape of the piston, the sleeve and the casing, the system of guiding the movements of the piston in relation to the sleeve, may be different.

I claim:

1. Device to control locking (30) of a cable boring corer (1) for a damp shaft, this corer comprising an exterior tube (2) in which an interior tube (5) slides, constituted by an attachment head and a cylindrical body possibly provided with a hydraulic tightness joint with the exterior tube (2) and locking means in relation to the exterior tube (2), characterized in that it comprises a deflecting casing (33), a sleeve (31) and a piston (32) which are movable in relation to the corer (1), means (46, 47) defining ports in the sleeve (31), and also a means associated with both the sleeve (31) and with the piston (32) to render them integral one with the other when a hydraulic pressure greater than a predetermined value has brought the piston (32) into a lower position which ensures the hydraulic tightness of the interior tube (5) with the exterior tube (2) such that, when the hydraulic pressure is reduced to a value lower than the predetermined value, the sleeve (31), integral with the piston (32) is brought into an upper position, such that it allows the circulation of a boring liquid between the exterior tube (2) and the interior tube (5) through the deflecting casing (33).

2. Device according to claim 1, comprising means for subjecting the piston (32), in the course of boring, to a hydraulic pressure on the one hand and to a counterforce on the other hand, of a predetermined value which opposes the displacement of the piston under the action of the hydraulic pressure, such that the piston (32) can be rendered integral with the sleeve (31) only when the hydraulic pressure applied on the piston (32) is greater than this predetermined value.

3. Device according to claim 2, characterized in that the means to render the piston (32) integral with the sleeve (31) is constituted by at least one finger (43) being able to project at one and the same time in the sleeve (31) and in the piston (32).

4. Device according to claim 3, characterized in that the piston (32) has a head having a cavity (42) in which the finger (43) is at least partially introduced to render the piston (32) integral to the sleeve (31).

5. Device according to claim 4, characterized in that to render the piston (32) integral with the sleeve (31), the finger (43) is subjected to the action of a force so as to ensure a permanent contact of this finger (43) with a surface of the sleeve (31) when the piston (32), not yet integral with the sleeve, is brought into the above-mentioned lower position by the hydraulic pressure.

6. Device according to claim 5, characterized in that the finger (43) is subjected to the action of a spring (44) resting on the base of the cavity (42).

7. Device according to claim 6, characterized in that the finger (43) projects in a hollow (45) of the sleeve (31).

8. Device according to claim 7, characterized in that the finger (43) is a ball of spherical shape.

9. Device according to claim 8, characterized in that the hollow (45) of the sleeve (31) has a hemispherical shape.

10. Device according to claim 4, characterized in that the head of the piston (32) and the sleeve (31) have at least one elongated hole providing for the passage of a pin integral with the deflecting casing, so as to guide the piston and the sleeve on their displacements in relation to the deflecting casing.

11. Device according to claim 1, characterized in that a spring (38) permanently draws the sleeve (31) towards its lower position in which it rests on an annular rim (40).

12. Device according to claim 7, characterized in that the hollow (45) of the sleeve (31) communicates through a duct (64) with the exterior surface of the sleeve (31), so as to allow the above-mentioned finger (43) to be dislodged from this hollow (45) to render the piston (3) non-integral with respect to the sleeve (31).

* * * * *